US005417868A

United States Patent [19]

Turner et al.

[11] Patent Number: 5,417,868

[45] Date of Patent: May 23, 1995

[54] FABRIC SOFTENING COMPOSITION

[75] Inventors: Graham A. Turner, Merseyside; Stuart A. Emmons, Clwyd, both of Great Britain

[73] Assignee: Unilever Patent Holdings B.V., Vlaardingen, Netherlands

[21] Appl. No.: 187,040

[22] Filed: Jan. 27, 1994

[30] Foreign Application Priority Data

Jan. 28, 1992 [GB] United Kingdom ..... 9301728
Apr. 5, 1993 [GB] United Kingdom ..... 9307031

[51] Int. Cl.[6] ..... C11D 1/62
[52] U.S. Cl. ..... 252/8.8; 252/8.6
[58] Field of Search ..... 252/8.8, 8.6, 8.75

[56] References Cited

U.S. PATENT DOCUMENTS 4,401,578 8/1983 Verbruggen ..... 252/8.8
4,426,299 1/1984 Verbruggen ..... 252/8.8

FOREIGN PATENT DOCUMENTS 13780 8/1980 European Pat. Off. .
507478 10/1992 European Pat. Off. .
523922 1/1993 European Pat. Off. .
1567947 5/1980 United Kingdom ..... 252/8.8

*Primary Examiner*—Anthony Green
*Attorney, Agent, or Firm*—Cushman Darby & Cushman

[57] ABSTRACT

A fabric softening composition which comprises a water insoluble cationic fabric softening agent of formula (I)

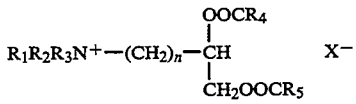

(I)

in which $R_1$ $R_2$ and $R_3$ are selected from $C_1$–$C_4$ alkyl, or hydroxyalkyl groups or $C_{2-4}$ alkenyl groups, $R_4$ and $R_5$ are independently selected from $C_{7-27}$ alkyl or alkenyl groups; and n is an integer from 0–5 and X is methyl sulphate. The claimed fabric softening composition exhibits good stability on storage.

7 Claims, No Drawings

FABRIC SOFTENING COMPOSITION

The present invention relates to fabric softening compositions, in particular the invention relates to aqueous dispersions of biodegradable fabric softening compositions comprising a water insoluble cationic fabric softening agent.

GB 1 567 947 describes a novel cationic diester which is used for fabric softening. The diester is highly biodegradable and can be represented by the formula

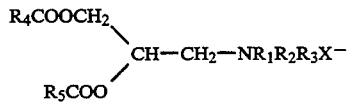

where $R_1R_2$ and $R_3$ are each an alkyl or hydroxyalkyl group containing from 1 to 4 carbon atoms, or a benzyl group, $R_4$ $R_5$ are each an alkyl or alkenyl chains containing from 11 to 23 carbon atoms, and $X^-$ is a water soluble anion.

The anion X is an anion of a strong acid and can be, for example, chloride, bromide, iodide, sulphate and methyl sulphate. All the examples in the patent specification have a chloride anion for example 1,2,dihardenedtallowoyl oxy-3-trimethylammoniopropane chloride.

Rinse added fabric softener compositions typically contain a water insoluble quaternary ammonium fabric softening agent dispersed in water at a level of softening agent up to 7% by weight in which case the compositions are considered dilute, or at levels from 7% to 50% in which case the compositions are considered concentrates.

A problem associated with fabric softening compositions is the physical instability of such compositions when stored. This problem becomes more serious as the concentration of the composition is increased and by storage at high or low temperatures.

Concentrates with good storage stability are desired by the consumer. Physical instability manifests as a thickening on storage of the composition to a level where the composition is no longer pourable and can even lead to gelation. The thickening is very undesirable since the composition can no longer be conveniently used.

In the past physical stability of rinse added fabric softener compositions has been improved by the addition of viscosity control agents or anti-gelling agents. For example in EP 13780 (Procter and Gamble) viscosity control agents are added to certain concentrated compositions. The agents may include $C_{10}$–$C_{18}$ fatty alcohols.

More recently in EP 507478 and EP 523922 (Unilever) it has been proposed to improve the physical stability of compositions comprising biodegradable, ester-linked quaternary ammonium compounds by the addition of selected nonionics. It would be preferable if the composition were stable without the need for such additional components.

Surprisingly we have discovered that aqueous rinse conditioner compositions formulated from the methyl sulphate of compound (I) are more stable than compositions formulated from the chloride of compound (I) employed hitherto.

Thus, according to one aspect of the invention there is provided a fabric softening composition comprising a water insoluble cationic fabric softening agent of formula (I)

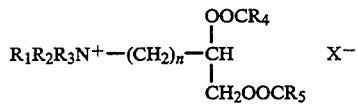

(I)

wherein $R_1$ $R_2$ and $R_3$ are independently selected from $C_{1-4}$ alkyl, or hydroxyalkyl groups or $C_{2-4}$ alkenyl groups; and wherein $R_4$ and $R_5$ are independently selected from $C_{7-27}$ alkyl or alkenyl groups; and n is an integer from 0–5 characterised in that X is methyl sulphate.

Preferably the compositions of the invention are liquids comprising an aqueous base.

Preferred materials of this class and their method of preparation are, for example, described in GB 1 567 947. Preferably these materials comprise small amounts of the corresponding monoester for example 1-hardened-tallowyloxy 2-hydroxy trimethyl ammonium propane methyl sulphate.

Preferably the level of ester linked quaternary ammonium compounds is at least 1% by weight of the composition, more preferably more than 3% by weight of the composition; especially interesting are concentrated compositions which comprise more than 7% of ester-linked quaternary ammonium compound. The level of ester-linked quaternary ammonium compounds is preferably between 1% and 80% by weight, more preferably 3% to 50%, most preferably 8% to 50%.

The composition can also contain fatty acids for example $C_8$–$C_{24}$ alkyl or alkenyl monocarboxylic acids or polymers thereof. Preferably saturated fatty acids are used, in particular, hardened tallow $C_{16}$–$C_{18}$ fatty acids. Preferably the fatty acid is non-saponified, more preferably the fatty acid is free, for example oleic acid, lauric acid or tallow fatty acid.

The level of fatty acid material is preferably more than 0.1% by weight, more preferably more than 0.2% by weight. Especially preferred are concentrates comprising from 0.1 to 20% by weight of fatty acid, more preferably 0.5% to 10% by weight. The weight ratio of quaternary ammonium material to fatty acid material is preferably from 30:1 to 1:10.

The composition may further comprise a nonionic stabilising agent which may be a linear $C_8$ to $C_{22}$ alcohol alkoxylated with 10 to 20 moles of alkylene oxide. Suitable nonionic stabilisers which can be used include the condensation products of $C_8$–$C_{22}$ primary linear alcohols with 10 to 20 moles of ethylene oxide. The term linear alcohol means a primary alcohol attached directly to a hydrocarbon backbone structure. The use of nonionic stabilisers with more than 20 ethylene oxide units will also provide the stability benefit. The alcohols may be saturated or unsaturated. In particular Genapol T-110, Genapol T-150, Genapol T-200, Genapol C-200 all ex Hoechst AG, Lutensol AT18 ex BASF, Genapol 0-100 and Genapol 0-150 ex Hoechst. Preferably these nonionic stabilisers have an HLB of between 10 and 20, more preferably 12 and 20. Fatty alcohols may also be used. Examples of fatty alcohols are Laurex CS, ex Albright and Wilson or Adol 340 ex Sherex.

Preferably, the level of nonionic stabiliser is within the range from 0.1 to 10% by weight, more preferably from 0.5 to 5% by weight, most preferably from 1 to 4% by weight.

The compositions of the invention preferably have a pH of more than 2, more preferably from 2 to 5.

The composition may also contain nonionic fabric softening agents such as lanolin and derivatives thereof.

The composition may also contain one or more optional ingredients, selected from non-aqueous solvents, pH buffering agents, perfumes, perfume carriers, fluorescers, colorants, hydrotropes, antifoaming agents, antiredeposition agents, enzymes, optical brightening agents, opacifiers, anti-shrinking agents, anti-wrinkle agents, anti-spotting agents, germicides, fungicides, anti-oxidants, anti-corrosion agents, drape imparting agents, antistatic agents and ironing aids.

The invention will now be illustrated by the following non-limiting examples. In the examples all percentages are expressed by weight.

Comparative Example 1

This example shows the change in viscosity with storage of 1,2-dihardenedtallowyl oxy-3-trimethylammoniopropane with a chloride anion. The raw material used was a mixture of 1,2-dihardenedtallowyl oxy-3-trimethylammoniopropane chloride with hardened tallow fatty acid in an Isopropyl alcohol solvent. The ratio of 1,2-ditallowyl oxy-3-trimethylammoniopropane chloride to fatty acid was >27:1 and the IPA content was about 27%. A 5% aqueous dispersion of the solids was made by adding molten raw material to water at 70° C. in a Heidolph mixer and mixing for 5 minutes before allowing the dispersion to cool to 30° C. with continued mixing. The viscosity of the fabric softening composition so produced was measured using a Haake RV20 rotary viscometer using a shear rate of $110s^{-1}$. The viscosity measured on the day the composition was made and the viscosity after 1 week's storage at 20° C. are given below in Table 1:

TABLE 1

| | |
|---|---|
| Initial Viscosity | 84 mPas |
| Viscosity at 1 week | Gel |

As can be seen from the table the 1,2-dihardenedtallowyl oxy-3-trimethylammoniopropane chloride forms a gel after 1 weeks storage at room temperature. This is extremely unsatisfactory.

Example 1

Comparative example 1 was repeated with the substitution of 1,2-dihardenedtallowyl oxy-3-trimethylammoniopropane methyl sulphate for 1,2-dihardenedtallowyl oxy-3-trimethylammoniopropane chloride. Viscosity data are given in the table below in Table 2:

TABLE 2

| | |
|---|---|
| Initial Viscosity | 76 mPas |

TABLE 2-continued

| | |
|---|---|
| Viscosity at 1 week | 70 mPas |

It can be seen that the problem of gel formation is eliminated by the use of the methyl sulphate anion, indeed there is a slight thinning of the composition with time.

Comparative Examples 2 and 3

To show that prior art disclosure of use of methyl sulphate anions with different quaternary ammonium compounds does not produce or suggest this effect we conducted experiments with DHTDMAC, a dihardened tallow dimethyl ammonium chloride sold under the name Arquad 2HT and its methyl sulphate equivalent, sold under the name Varisoft 137. It can be seen from Table 3 that there is no gel formation after 1 week's storage of the chloride product and that the viscosity change of both softening compositions is about the same.

TABLE 3

| Composition | Initial Viscosity | 1 week Viscosity |
|---|---|---|
| DHTDMA chloride | 104 | 99 |
| DHTDMA methyl sulphate | 192 | 175 |

We claim:

1. A fabric softening composition having enhanced stability comprising a water insoluble cationic fabric softening agent of formula (I)

$$R_1R_2R_3N^+-(CH_2)_n-\underset{\underset{CH_2OOCR_5}{|}}{\overset{\overset{OOCR_4}{|}}{CH}} \quad X^- \qquad (I)$$

wherein $R_1$ $R_2$ and $R_3$ are independently selected from $C_{1-4}$ alkyl, or hydroxyalkyl groups or $C_{2-4}$ alkenyl groups; and wherein $R_4$ and $R_5$ are independently selected from $C_{7-27}$ alkyl or alkenyl groups; and n is an integer from 0–5 and X is methyl sulphate.

2. A composition according to claim 1 which further comprises up to 15% by weight of a corresponding monoester.

3. A composition according to claim 1 or claim 2 which further comprises from 0.1 to 20% by weight of a fatty acid.

4. A composition according to claim 1 which further comprises from 0.1 to 10% by weight of a nonionic stabilising agent.

5. A composition according to claim 1 wherein the composition has a pH between 2 and 5.

6. A liquid composition according to claim 1 which comprises an aqueous base.

7. A composition according to claim 1 which is 1,2-dihardenedtallowyl oxy-3-trimethylammoniopropane methyl sulphate.

* * * * *